US007186176B2

(12) United States Patent
Umeda

(10) Patent No.: US 7,186,176 B2
(45) Date of Patent: Mar. 6, 2007

(54) COIN DISPENSING APPARATUS WITH SAFE HOUSING

(75) Inventor: Masayoshi Umeda, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 23 days.

(21) Appl. No.: 11/075,591

(22) Filed: Mar. 9, 2005

(65) Prior Publication Data

US 2005/0236254 A1 Oct. 27, 2005

(30) Foreign Application Priority Data

Mar. 18, 2004 (JP) ..... 2004-077433

(51) Int. Cl.

| | |
|---|---|
| ***G07D 1/00*** | (2006.01) |
| ***G07D 1/02*** | (2006.01) |
| ***B65H 1/00*** | (2006.01) |
| ***E05G 1/00*** | (2006.01) |
| ***E05G 1/02*** | (2006.01) |

(52) U.S. Cl. ..... 453/29; 221/151; 221/197; 221/287; 109/47

(58) Field of Classification Search ..... 453/29, 453/18, 30, 32, 33, 49, 57; 221/151, 287, 221/197; 232/1 D, 4 D, 55, 15, 16; 109/45, 109/46, 56, 57; 206/0.815, 0.8, 0.81, 807; 194/350, 351; 70/DIG. 41

See application file for complete search history.

(56) References Cited

U.S. PATENT DOCUMENTS 3,926,366 A * 12/1975 Sciortino ..... 232/15
5,046,989 A * 9/1991 Dass ..... 453/17
5,667,096 A * 9/1997 Wu ..... 221/6
6,073,799 A * 6/2000 Yuyama et al. ..... 221/154
6,823,977 B2 * 11/2004 Abe ..... 194/351

FOREIGN PATENT DOCUMENTS

| | | |
|---|---|---|
| GB | 2.352.316 A * | 1/2001 |
| JP | 2514825 | 4/1996 |
| JP | 11-250301 | 9/1999 |

* cited by examiner

*Primary Examiner*—Patrick Mackey
*Assistant Examiner*—Mark J. Beauchaine

(57) ABSTRACT

The first purpose of this present invention is to provide a coin dispensing safe assembly with a safe system which can prevent coins being stolen. The second purpose of this invention is to provide a coin dispensing safe assembly with a safe system which can prevent coins being stolen, also it is easy and inexpensive. A coin dispensing safe assembly with a safe system includes a coin dispensing safe assembly having a rotating disk with through holes which is located at the bottom of a coin storing bowl with an upper opening and which is rotated by a motor. A safe housing, which is built to enclose said coin dispensing safe assembly and which can be detached from a coin handling apparatus, includes a dispensing slot for dispensing coins and a disabling unit for the coin dispensing safe assembly, when the safe housing is detached from the coin handling apparatus.

6 Claims, 8 Drawing Sheets

COIN DISPENSING APPARATUS WITH SAFE HOUSING

BACKGROUND OF THE INVENTION

1. Field of the Invention

The present invention is directed to a coin dispensing apparatus which can be detached from a coin handling machine, and more particularly to a coin dispensing apparatus with a safe system, whereby it is difficult to steal coins from the coin handling apparatus.

2. Description of Related Art

In Japanese Patent No. 2514825, two hoppers which include a rotating disk with through holes are located in a safe unit with a lid which can be locked.

In Japanese Laid Open Patent 11-250301, a hopper includes a rotating disk with through holes which is driven by an electric motor located at the bottom of a storing bowl which has an upper opening, and the hopper, dispenses coins one by one.

In the Japanese Patent No. 2514825, when the safe unit which is coin dispensing apparatus is attached onto a charging apparatus which is a coin handling apparatus, a shutter is automatically opened, and can receive coins at the charging apparatus. When the safe unit is detached from the charging apparatus, the shutter isn't automatically closed. Also, the dispensing slot for the coins of the hopper and the driving section of the rotating disk are exposed. Accordingly, the rotating disk can be rotated by an outside instrument and the coins can be stolen.

In the Japanese Laid Open Patent 11-250301, the dispensing slot for the coins is exposed. Therefore, an object can be inserted into the dispensing slot and the rotating disk is rotated by the inserted tool. As a result, coins can be stolen.

SUMMARY OF THE INVENTION

A first purpose of this present invention is to provide a coin dispensing apparatus with a safe system which can prevent coins from being stolen.

A second purpose of this invention is to provide a coin dispensing apparatus with a safe system of a relatively inexpensive design.

A third purpose of this invention is to provide a safe housing having a lockable cover with an interior storage space for coins and a dispensing slot for releasing coins, the safe housing being of a configuration for removably mounting in a coin dispensing safe assembly, a coin dispensing member mounted in the safe housing for selectively delivering coins to the dispensing slot; and a disabling unit for automatically preventing the release of coins from the safe housing when the safe housing is removed from the coin dispensing safe assembly.

A coin dispensing apparatus with a safe system can include a coin dispensing apparatus includes a rotating disk with through holes which is located at the bottom of a coin storing bowl with an upper opening and which is rotated by a motor. A safe housing which is built for insertion into the coin dispensing apparatus and which can be detached from coin handling apparatus, includes a dispensing slot for dispensing coins and a disabling unit for a coin dispensing unit which is activated when the safe housing is detached from the coin handling apparatus.

In this structure, the coin dispensing unit is built into the safe housing. When the safe housing is drawn out from the coin handling apparatus, an upper opening is covered by a safe housing lid. Therefore, the bulk coins in the storing bowl of the coin dispensing apparatus can't be stolen. Also, the rotating disk for dispensing the coins can't be rotated, because the rotating disk is stopped by the disabling unit. Therefore, the rotating disk can't be rotated to direct coins to the coin dispensing slot. As a result, the stored coins in the storing bowl aren't dispensed, and the coins are safe.

In this present invention, the disabling unit is a rotation stopping unit for locking the rotating disk. Therefore, when the rotating disk receives a rotating force from an inserted object through the coin dispensing slot of the safe cover, the rotating disk is un-rotatable, and the coins in the coin dispensing unit aren't dispensed.

The rotating disk can be driven by an electric motor through a transfer mechanism. The disabling unit includes a stopping tooth on a lever which can engage with the transfer mechanism. In this structure, when the safe housing is detached from the coin handling apparatus, the rotating disk is locked, because the stopping tooth can engage with the transfer mechanism which is located between the motor and the rotating disk. Therefore, if someone or something ties to interfere, the rotating disk can not be rotated. The rotating disk is stopped by the stopping tooth, and the stored coins in the coin dispensing unit aren't dispensed.

The disabling unit includes a shutter which can shut a dispensing slot for the coins. In this structure, when the coin dispensing safe assembly with a safe system is detached from the coin handling apparatus, the coin dispensing slot of the safe housing is closed by the shutter. Accordingly, other foreign objects can't be inserted into the dispensing slot. As a result, an effect the same as a locked rotating disk can be achieved. In other words, the rotating disk can't be rotated by other forces, and the stored coins in the coin dispensing unit aren't dispensed.

An opening for a connector for operating the motor is located at the front surface of the safe housing. In this structure, the coin dispensing slot and the opening of the connector for providing the driving source to the motor are located at the front surface of the safe cover. The coin receiving slot from the coin dispensing slot and the connector are located at the coin handling apparatus corresponding to the opening and the connector. Therefore, when the safe housing is moved towards the inside of the coin handling apparatus, the connectors are forced together and connected, and the coin slots are also automatically coupled. As a result, this transaction is conveniently installed and removed.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Also, the coin handling apparatus is, for example; a money changer, an automatic changer or the like. In this specification, "coin" includes generally a coin, a token for amusement and any dispensable medium which has the same function.

Figure 1:
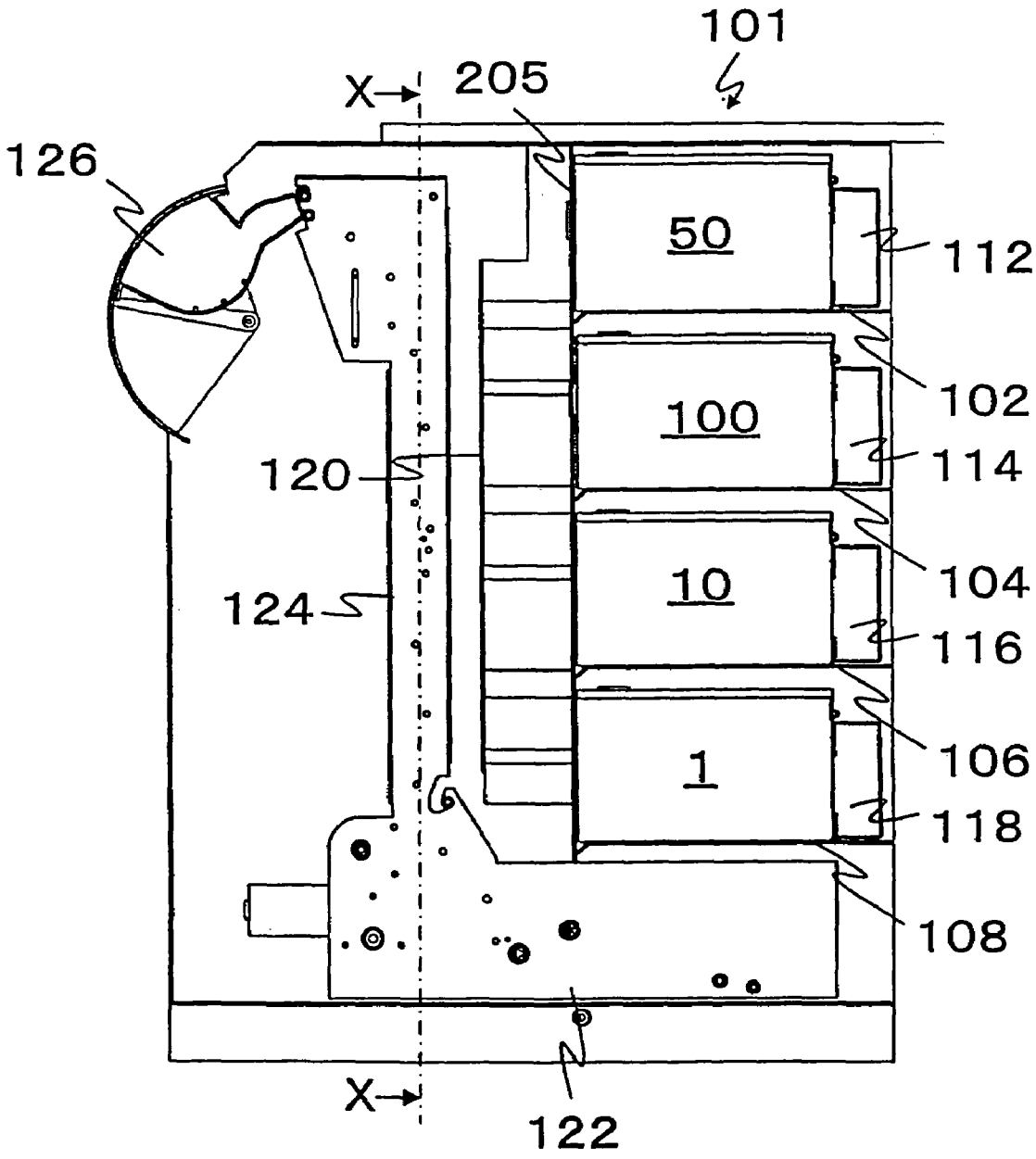
FIG. 1(A) is a cross-section view of a coin changing apparatus where a coin dispensing apparatus with a safe system can be removably installed.
FIG. 1(B) is a cross-section view of X—X line in FIG. 1(A).
Figure 1:
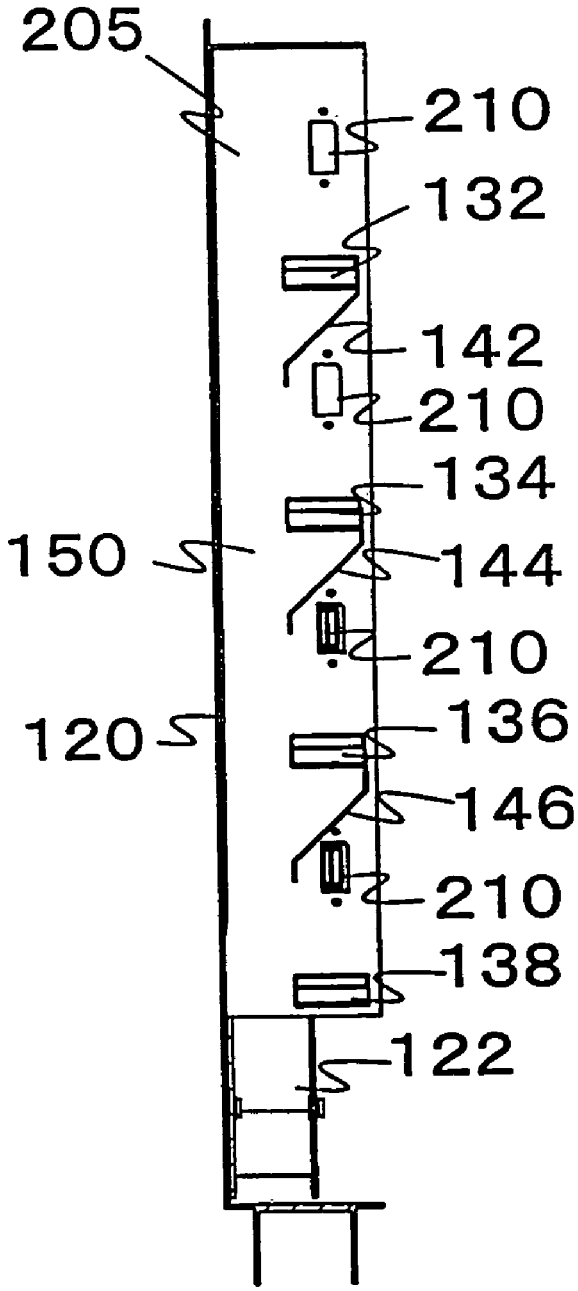

In these embodiments, the coins are Japanese Yen; however, other coins can be used, for example, US dollar coins or Euro coins. In FIG. 1(A), the coin handling apparatus 101 is an automatic changing machine or an ATM which dispense a predetermined domination and a predetermined quantity based on a directing signal.

Referring to FIGS. 1A and 1B, coin dispensing safe assembly 50 for 50 Yen, coin dispensing safe assembly 100 for 100 Yen, coin dispensing safe assembly 10 for 10 Yen and coin dispensing safe assembly 1 are located at safe areas 112, 114, 116 and 118 which are aligned perpendicularly within a coin dispensing machine 101. Safe areas 112, 114, 116 and 118 are divided by separating plates 102, 104, 006 and 108 which are located perpendicularly at a predetermined distance. Coin dispensing safe assemblies 50, 100, 10 and 1 are removably detached respectively to safe areas 112, 114, 116 and 118.

Coin dispensing safe apparatuses which dispense a lot of coins can be located at lower positions. Also safe type dispensing apparatuses which dispense lightweight coins can be located at lower positions and the safe dispensing apparatuses for heavier coins are located at the upper positions. In these cases, the dispensing time for releasing all coins can be made as short as possible. Coin safe dispensing apparatuses 50, 100, 10 and 1 dispense the coins into a falling duct 120 which is located beside the safe area.

The dispensed coins fall within duct 120 and land on a lateral direction transporting unit 122 which is located under the duct 120. For example, the lateral direction transporting unit 122 can be a belt. The fallen coins are transported towards the lateral direction by lateral direction transporting unit 122 and are received by lifting unit 124. Afterwards, the coins are lifted upwards by the lifting unit 124. Lateral direction transporting unit 122 has a function which transports the fallen coins away from falling duct 120. Therefore, the fallen coins can be moved either obliquely upwards or obliquely downwards.

The coins moved by lifting unit 124 are dispensed into a receiving slot 126 which is bowl shape. Dispensing slots 132, 134, 136 and 138 of safe areas 112, 114, 116 and 118 are operatively connected to falling duct 120 and are located at one-side towards the right at plate 205 for defining falling duct 120 as shown in FIG. 1(B).

Dispensed coins from dispensing slots 132, 134, 136, 138 fall onto first slanting guide plates 142, 144, 146, 148 (shown in FIG. 2) which are located under dispensing slots 132, 134, 136, 138 and are slanted at a right angle to the coin dispensing directions, and the coins are guided towards the left in FIG. 1(B). Afterwards, the coins fall in falling passageway 150 which extends perpendicularly, and go onto lateral direction transporting unit 122.

Second slanting guide plate 143 which extends at a right angle to first slanting guide plate 142 is located below the first slanting guide plate 142 which is located at an uppermost position. Second slanting guide plate 145 which extends at a right angle to second slanting guide plate 144 is located below first slanting guide plate 144 which is located at a second upper position.

First slanting guide plates 142, 144, 146, 148 and second slanting guide plates 143, 145 form a speed reducing unit 152 for reducing the falling speed as the dispensed coins fall onto the lateral direction transporting unit. In other words, the dispensed coins which were dispensed from each dispensing slots 132, 134, 136, 138 are approximately level. Accordingly, the dispensed coins have contact with the surfaces and are guided by first slanting guide plates 142, 144, 146, 148 and second slanting guide plates 143, 145. Therefore, the coin speed is reduced by the friction between the guide plates and the coins. Afterwards, the coins fall from the ends of slanting guide plates 143, 145, 146, 148 which are located below dispensing slots 143, 134, 136, 138. Accordingly, the falling speed onto lateral direction transporting unit 122 is reduced. Therefore, the coin action of bounce or rebounding is reduced. As a result, the coins are transported quickly.

Figure 2:
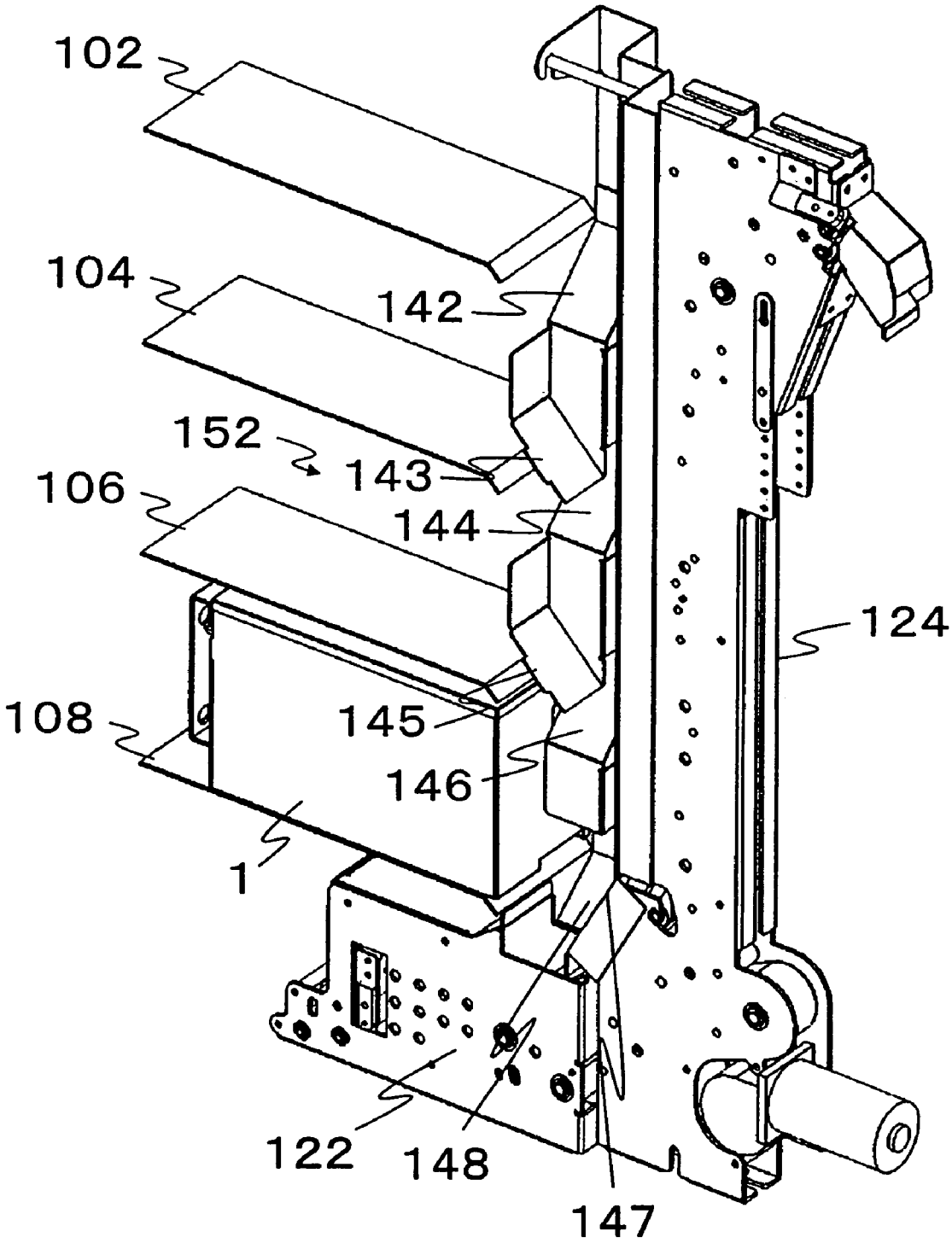
FIG. 2 is an exploded perspective view of a dispensing duct of the coin handling apparatus.

Speed reducing unit 152 is structured so that the second slanting guide plates 143, 145 are located under the first slanting guiding plates 142, 144 and are configured in a zigzag manner as shown in FIG. 2. This structure is desirable, because the speed reducing effect on the coins is increased. Also, the dispensed coins which are dispensed by coin dispensing apparatus 50, 100 fall from the lower ends of second slanting guiding guide plates 143, 145 and fall onto third slanting guide plate 147. The coins are guided towards the side by third slanting guide plate 147, and fall onto lateral direction transporting unit 122.

The dispensed coins which are dispensed by coin dispensing safe assemblies 10, 1, which are located at a lower position fall directly onto lateral direction transporting unit 122 from first slanting guide plates 146, 148. Accordingly, the falling position of the coins is dispersed. As a result, the coins are lifted smoothly by lifting unit 124.

Next, the structure of coin dispensing safe assemblies 50, 100, 10, 1 which are in the present invention is explained referring to FIGS. 3–7. Coin dispensing safe assemblies 50, 100, 10, 1 each has the same structure. Therefore, coin dispensing safe assembly 50 which is located at the uppermost position is explained on behalf of the other apparatuses. Coin dispensing safe assembly 50 includes a coin hopper with a rotating disk 160, safe housing 164 which has a built-in hopper 162 and disabling unit 166 for contacting the rotating disk 160.

Next coin hopper 162 is explained. Coin hopper 162 includes coin storing bowl 170, a rotating disk 160, a motor 174 and transmitting mechanism 176. Coin storing bowl 170 is configured like a cylinder and can be detached to the upper surface of base 168. Rotating disk 160 is located in a circular hole 172 which is located at the bottom of bowl 170. Motor 174 (an electric motor in this embodiment) is fixed at the upper surface of base 168. Transmitting mechanism 176 transmits the rotation from motor 174 to rotating disk 160 (shown in FIG. 7).

Motor 174 can be changed to either an air-motor, a hydraulic motor or other motive device. An electric motor is desirable, because an electric motor can be made small and compact and does not require incidental equipment. In this embodiment, transmitting mechanism 176 is a gear transmission which includes plural gears 178. The transmitting mechanism 176 can be changed to another transmitting mechanism which has same function.

Bowl 170 is a cylinder which extends perpendicularly, the upper opening 180 has a rectangle shape and the lower opening is a circular hole 172. Rotating disk 160 includes a plurality of through holes 182 which are located at predetermined intervals and receive the stored coins. Also the rotating disk 180 includes pushing ribs 184 which are located at the reverse of the rotating disk 160 which face base 168. The lower section of rotating disk 160 is located at circular hole 186 which is formed at the upper surface of base 168.

Rotating disk 160 is fixed to rotating shaft 188. Gear 178 is fixed at rotating shaft 188. Coin outlet 190 is a notched position which is located at circular holes 186 and 172. The coins which fall into through hole 182 of rotating disk 160 are supported on the upper surface of base 168 and are guided by the inner surface of circular hole 186 and move together with rotating disk 160. The coins are pushed out at coin outlet 190 by pushing rib 184; afterwards, the coins are flipped by a flipping unit (not shown).

A sensor (not shown) which detects the movement of the flipping unit outputs a counting signal for the coins. The coin hopper 162 is a known hopper, for example, as shown in Japanese Laid Open Patent 2000-132723.

Next safe housing 164 is explained. Safe cover 164 is a box which is made by a cover body 192 which is a box with a bottom and is opened at an upper opening with a lid 194 which covers the upper opening. Cover body 192 and lid 194 can be formed by a stainless steel plate. Coin hopper 162 is built into safe housing 164. In other words, coin hopper 162 is covered by safe housing 164.

Lid 194 is a box which is opened at the bottom and can pivot on shaft 196 at a rear wall 214 of cover body 192 in an up and down direction. Also lid 194 covers the upper opening of cover body 192 and can be locked to cover body 192 by locking unit 198. Therefore, safe housing 164 has a safety function for coin hopper 162. In other words, coin hopper 162 which is built into safe cover 164 is a coin dispensing apparatus within a safe system.

Front slanting section 200 extends backwards and downwards and is fixed at the front upper section of cover body 192. Rear slanting section 202 is fixed at the rear upper section. These lower sections are located in the upper opening 180 of bowl 170. By this, the entered coins into the upper opening of cover body 192 are guided by slanting sections 200 and 202; afterwards, the coins fall into bowl 170 and pass through upper opening 180.

Figure 3:
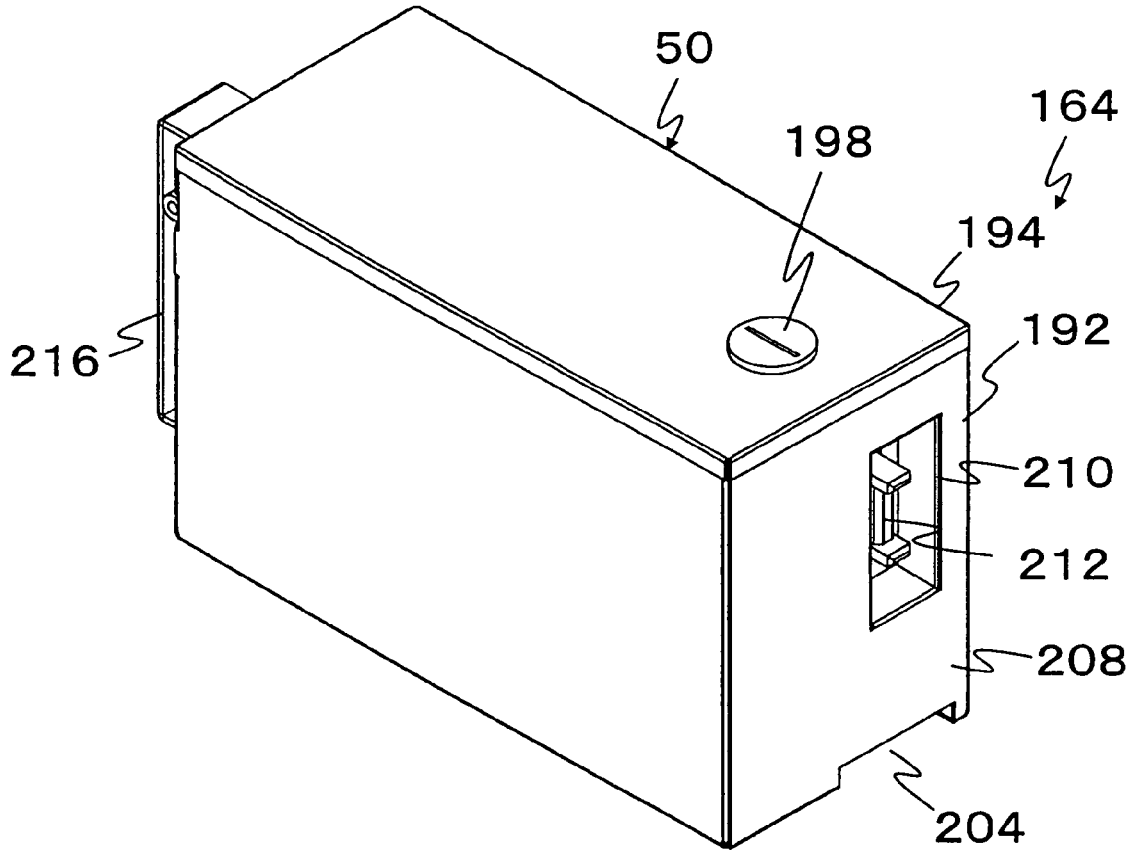
FIG. 3 is a perspective view of the coin dispensing apparatus with a safe system.

Safe dispensing outlet 204 is located at cover body 192 which is located face-to-face with coin outlet 190 of coin hopper 162. Coin dispensing outlet 204 is a slot and is located at the lower edge section of front wall 208 of cover body 192 as shown in FIG. 3. Safe dispensing slot 204 and coin dispensing slot 190 of coin hopper 162 are a flat nozzle shape and are connected by guide 206 which is fixed at the inside of cover body 192. In other words, the flipped coins from coin outlet 190 are guided by guide 206, and are dispensed in a slant situation position from safe outlet 204.

When coin dispensing safe assembly 50 is moved to a predetermined position at safe area 112 along separating plate 102; safe dispensing outlet 204 is located near coin dispensing outlet 132 which is located at plate 205 for defining safe areas 112, 114, 116, 118. Opening 210 is rectangular and is located at front wall 208 which is located above safe dispensing slot 204.

First connector 212 for driving motor 174 and for connecting the counting sensor is fixed at the inside of opening 210. In other words, first connector 212 is located inside safe cover 164, and doesn't protrude to the outer surface. Accordingly, when the coin dispensing safe assembly 50 is carried when removed by an operator, first connector 212 doesn't protrude and isn't likely to get broken. Handle 216 which is a ring or U-shaped member is fixed at rear wall 214 which is located opposite to front wall 208 of cover body 192. When coin dispensing safe assembly 50 with safe system is carried, handle 216 is held by a person.

Second electrical connector 218 which is fitted to first electrical connector 212 is fixed at plate 205 which is located opposite to front wall 208 of safe area 112 of coin handling apparatus 101. When coin dispensing safe assembly is attached to safe area 112, second connector 218 is fitted to first connector 212. Accordingly, the power line of motor 174, the signal lines for the sensor and the empty sensor of bowl 170 are connected automatically during insertion and disconnected automatically during removal.

Second connector 218 is connected to a circuit for controlling a power circuit. When motor 174 isn't an electric motor; for example, when the motor is an air motor, first connector 212 and second connector 218 can include a connector for an air pipe for providing compressed air.

Figure 4:
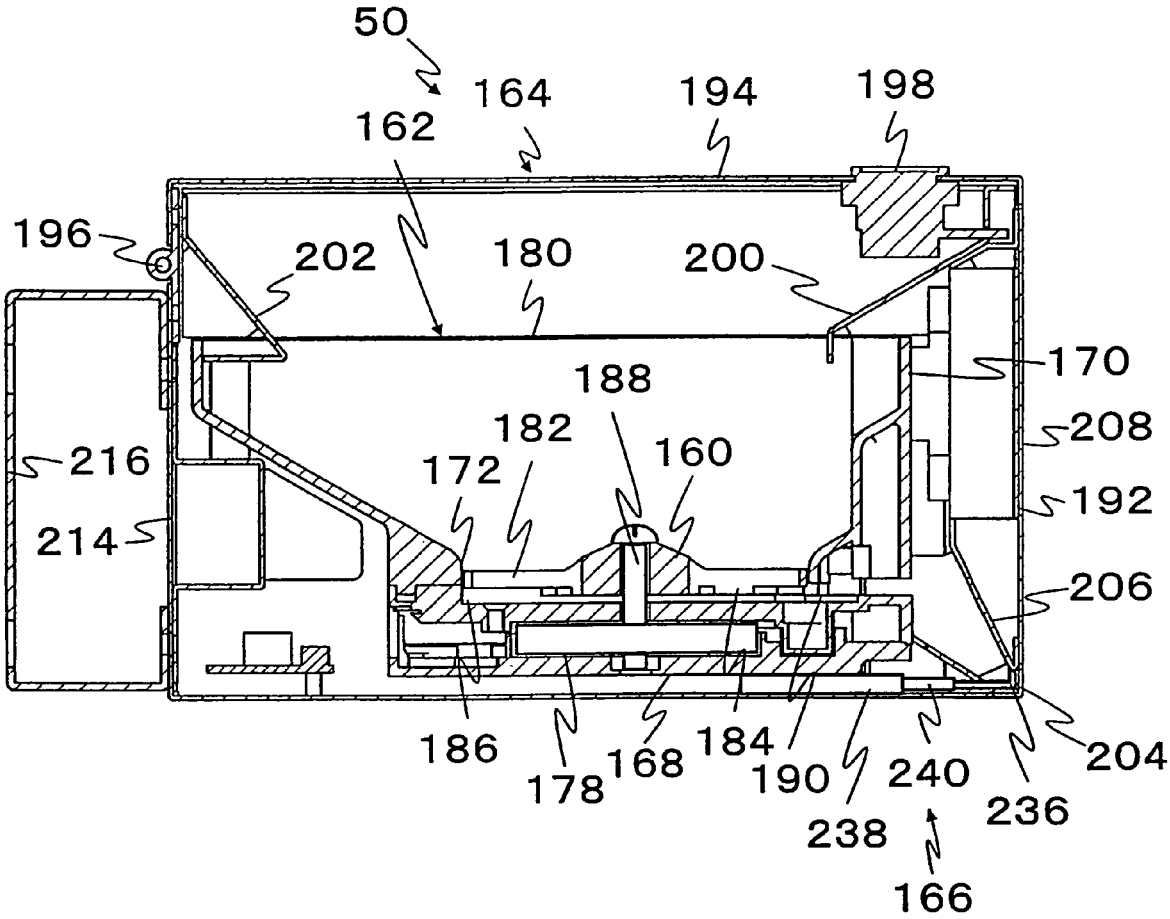
FIG. 4 is a cross-section view along a line which passes through the center of the rotating disk of the coin dispensing apparatus with a safe system.
Figure 5:
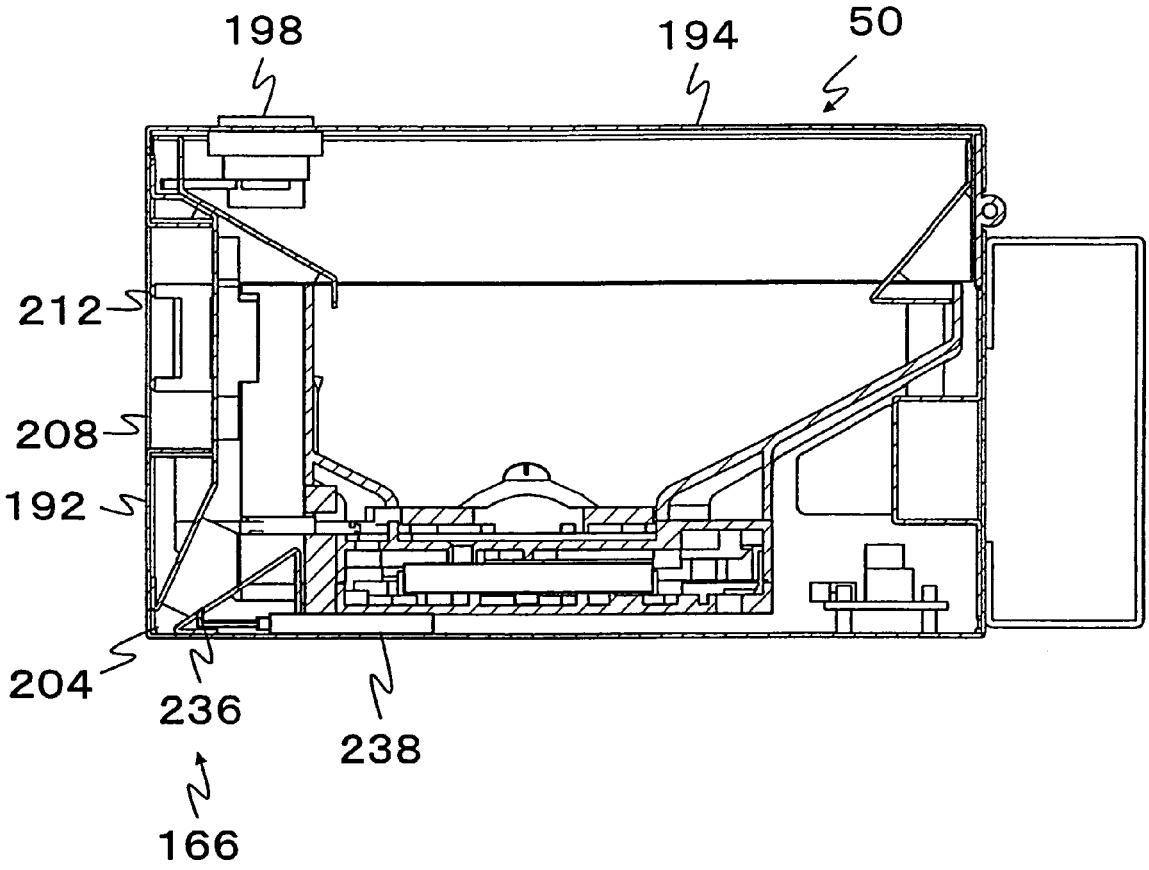
FIG. 5 is a cross-section view of the coin dispensing slot of the coin dispensing apparatus.
Figure 6:
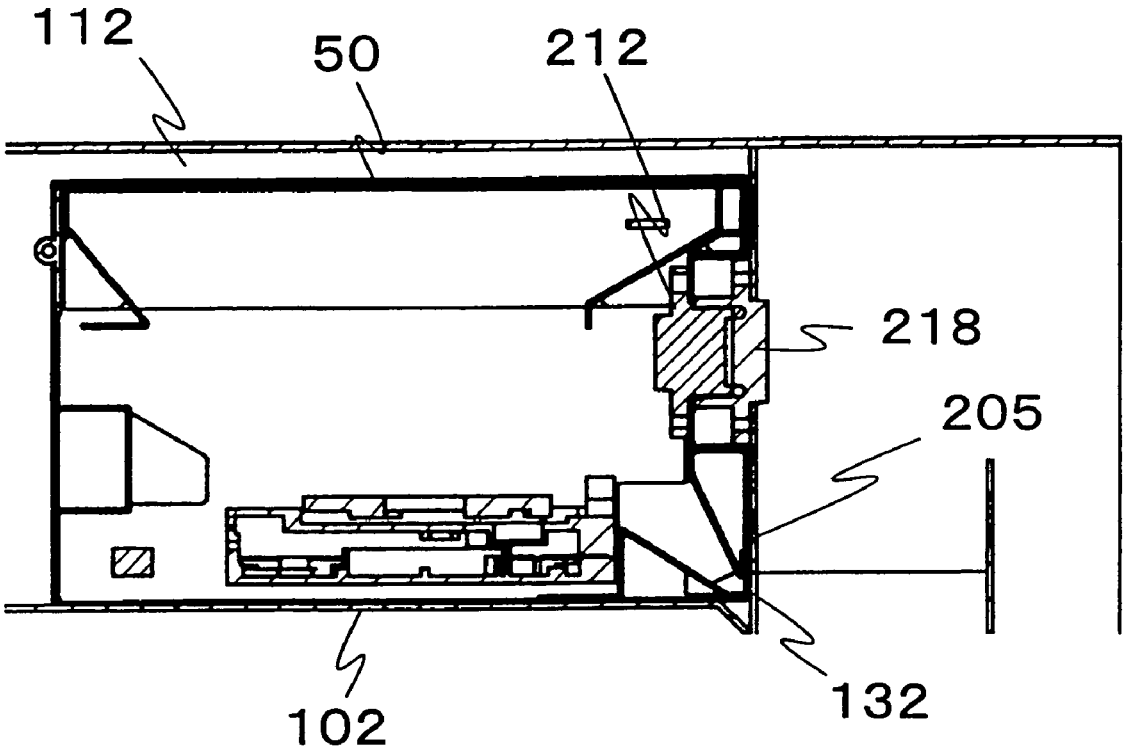
FIG. 6 is a cross-section view of the coin dispensing section where the coin dispensing apparatus with a safe system of this embodiment is attached to the changing apparatus.
Figure 7:
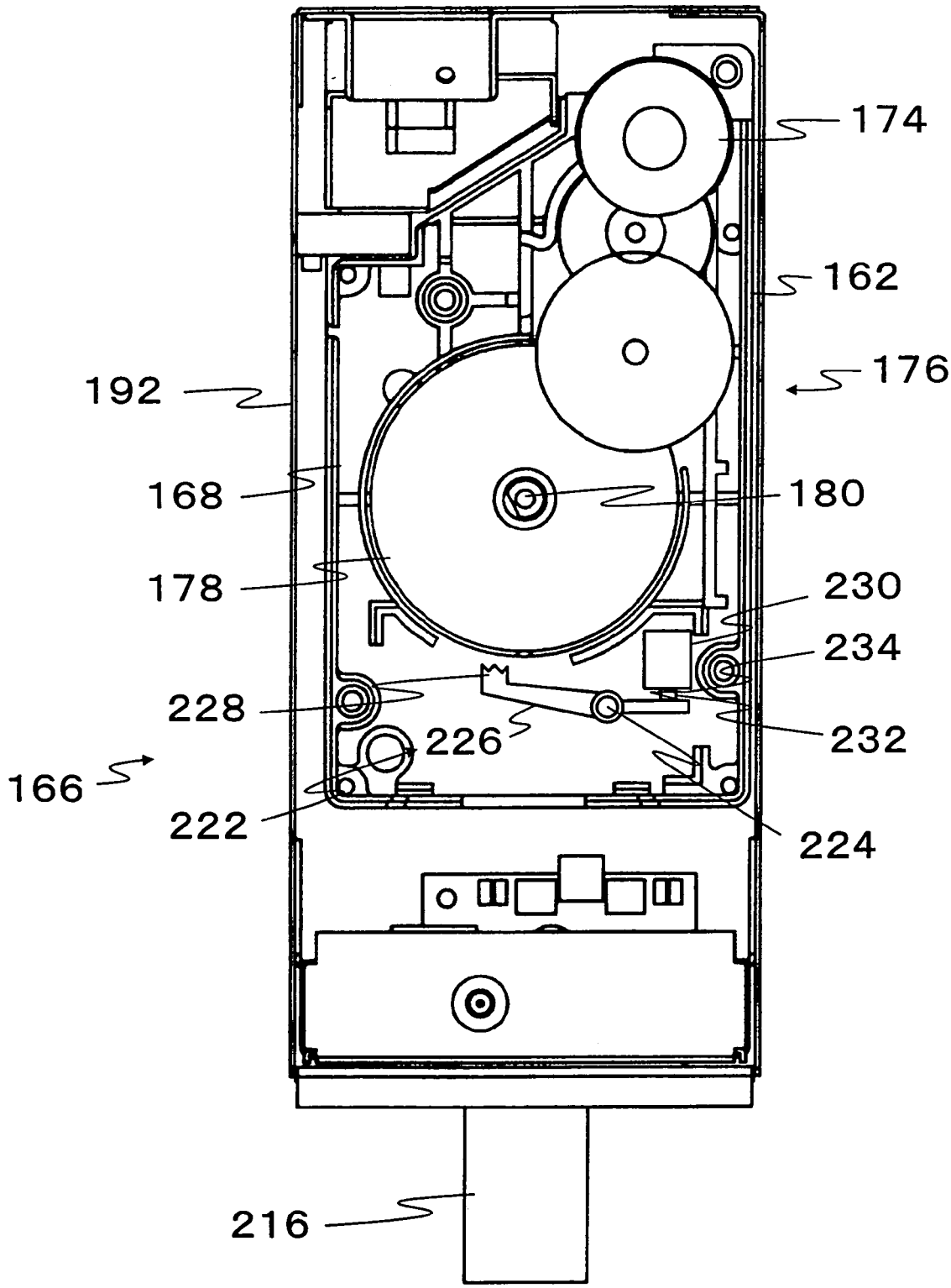
FIG. 7 is an outline view of the disabling unit relative to the rotating disk of the coin dispensing apparatus with a safe system.

Next, disabling unit 166 for rotating disk 160 is explained by referring to FIGS. 4 and 7. The first embodiment of disabling unit 166 is disclosed in FIG. 7. The disabling unit 166 is a rotation preventing unit 222 for stopping the rotation of rotating disk 160. Rotation preventing unit 222 has a function that when first connector 212 is disconnected from second connector 218, a stopper member has automatic contact with either rotating disk 160 or transmitting mechanism 176. In other words, rotating disk 160 can't be rotated.

Rotating preventing unit 222 is explained by referring to FIG. 7. Lever 226 is pivotable on shaft 224 which is fixed at base 168. There is stopping tooth 228 at an end of lever 226. Stopping tooth 228 engages gear 178. Plunger 232 of solenoid 230 which is fixed at base 168 is connected with the end of lever 226. When plunger 232 is pulled by the activation of solenoid 230, stopping tooth 228 moves away from gear 178.

Lever 226 is urged by spring 234 as stopping gear 228 has contact with gear 178. In other words, when solenoid 230 isn't excited or powered, stopping tooth 228 is engaged with gear 178 by spring 234. In other words, when the power for solenoid 230 is stopped, stopping tooth 228 engages with gear 178. Therefore, gear 178 can't rotate.

Rotation preventing unit 222 can be changed to another unit which has the same function where the rotating disk 160 is stopped. For example, there can be a hole which penetrates through gear 178. When solenoid 230 isn't excited, a pin can be inserted into the hole or alternatively the pin is inserted into through hole 182 of rotating disk 160.

The rotation of motor 174 is transmitted to a worm gear which drives gear 178 which is a worm wheel. In other words, the worm wheel can't be rotated by the self-lock function. Therefore, the worm wheel and the worm gear can be a rotation preventing unit 222. When rotation preventing unit 222 operates, gear 178 can't be rotated by an object which is inserted through safe dispensing slot 204 and coin outlet 190. Accordingly, rotating disk 160 isn't rotated, and the coins which are stored in bowl 170 aren't dispensed.

Next, a second embodiment of disabling unit 166 is explained. Disabling unit 166 includes shutter 236 which closes safe dispensing slot 204 as shown in FIG. 4. Shutter 236 can slide along the bottom of cover body 192 and base 168 by solenoid 238. When solenoid 238 is excited, safe dispensing slot 204 is opened by shutter 236 which is pulled by plunger 240 (shown in FIG. 5). When solenoid 238 isn't excited, safe dispensing slot 204 is closed by shutter 236 which is pulled by a spring (not shown).

Therefore, when shutter 236 closes safe dispensing slot 204, an object can't be inserted into safe dispensing slot 204 by someone trying to steal the coins. As a result, the coins in bowl 170 aren't dispensed, because rotating disk 160 can't be rotated. Also, rotation preventing unit 222 and shutter 236 are used together, but can also be used individually.

Next, an operation of this embodiment is explained. When coin dispensing safe assemblies 50, 100, 10, 1 are individually moved along separating plates 102, 104, 106, 108, the respective first connectors 215 are fitted to second connectors 218 which are fixed at coin handling apparatus 101. Accordingly, motors 174 of each coin dispensing safe assemblies 50, 100, 10, 1 are connected to the power source and can receive controlling signals. Also, the respective safe dispensing slots 204 are located near the dispensing slots 132, 134, 136, 138. Afterwards, solenoids 230 and 238 are excited to open the dispensing slot and release the gear 178.

Lever 226 is pivoted in a counterclockwise direction, as shown in FIG. 7, by the excitement of solenoid 230, and stopping tooth 228 is moved away from gear 178. By this activation, gear 178 can be rotated by motor 174. Also, shutter 236 is moved to the opening position shown in FIG. 5 by the excitation of solenoid 238. Accordingly, safe dispensing slot 204 is opened. As a result, the dispensed coins which are dispensed from coin outlet 190 can be dispensed from safe dispensing slot 204.

Next, in the case where 482 Yen is dispensed is explained. In other words, coin dispensing safe assembly 100 dispenses four coins, coin dispensing safe assembly 10 dispenses three coins, coin dispensing safe assembly 50 dispenses one coin and coin dispensing safe assembly 1 dispenses two coins. The start timing of coin dispensing safe assemblies which are selected are slightly staggered for prevention to simultaneously start the currents together. By this action, the apparatus can be made inexpensively and can dispense the coins quickly.

For example, coin dispensing safe assembly 100, coin dispensing safe assembly 10, coin dispensing safe assembly 1 and coin dispensing safe assembly 50 are started in turn. The sensors for counting the coin dispensing safe assemblies 100, 1, 50 detect the coins. When the sensors detect a predetermined coin, motors 174 of the coin dispensing safe assemblies are stopped by the controlling unit.

50 Yen coins which were dispensed from safe dispensing slot 204 of coin dispensing safe assembly 50 fall into falling duct 120 from dispensing slot 132, contact first slanting guide plate 142 which is located under the dispensing slot 132. Afterwards, the dispensed coins slide at a right angle to the dispensing direction. The fallen 50 Yen coins from the end of first slanting plate 142 fall onto second slanting guide plate 143 which is located under first slanting plate 142. Afterwards, the coins slide to the same direction to the dispensing direction on second slanting plate 143.

The fallen 50 Yen coins from the lower end of second slanting guide plate 143 fall in falling passageway 150 which extends perpendicularly, and contact third slanting guide plate 147. Afterwards, the coins are turned towards the side of safe area 118 by the slant, and fall onto lateral direction transporting unit 122.

Therefore, 50 Yen coins slide on first slanting guide plate 142 and second slanting guide plate 143. As a result, the sliding speed is reduced. Afterwards, the coins fall from the lower section of second slanting guide plate 143 which is located under dispensing slot 132, and contact third slanting guide plate 147. Afterwards, the coins fall onto lateral direction transporting unit 122. Therefore, the shock where the coins contact lateral direction transporting unit 122 is reduced drastically. As a result, the coin's transportation is finished quickly, because the coins don't bounce as much.

Next, 100 Yen coins which were dispensed from coin dispensing safe assembly 100 slide on fist slanting guide plate 142 and second slanting guide plate 143 as the same as 50 Yen coins. Afterwards, the coins fall in falling passageway 150, and are guided to the side by third slanting guide plate 147 and fall onto lateral direction transporting unit 122. Therefore, the bouncing of 100 Yen coins comes to a rest quickly as the same as the above-mentioned.

Next, 10 Yen coins which were dispensed from coin dispensing safe assembly 10 slide on fist slanting guide plate 142. Afterwards, the coins fall in falling passageway 150, and fall onto lateral direction transporting unit 122. Therefore, the height of the end of first slanting guide 142 from lateral direction transporting unit 122 is low. As a result, the bounce of 10 Yen coins comes to a rest quickly.

Next, 1 Yen coins which were dispensed from coin dispensing safe assembly 1 slide on fist slanting guide plate 142 as the same as 10 Yen coins. Afterwards, the coins fall in falling passageway 150, and fall onto the lateral direction transporting unit 122. Therefore, the height of the end of first slanting guide 142 from lateral direction transporting unit 122 is low. As a result, the bounce of 10 Yen coins comes to a rest quickly.

When the transporting distance of lateral direction transporting unit 122 is short, the coin's bouncing will come to a rest quickly, before the coins arrive to lifting unit 124. Therefore, the coins are lifted by lifting unit 124. In other words, the coin's dispensing time is reduced and the coin handling apparatus can be made small and compact.

When coin dispensing safe assemblies 50, 100, 10, 1 are detached from safe areas 112, 114, 116, 118, first connectors 212 are released from second connectors 218. Therefore, solenoids 230 and 238 aren't excited. By this, lever 226 is pivoted in the clockwise direction by spring 234. Accordingly, stopping tooth 228 has engaged with gear 178. Gear 178 can't be rotated. As a result, rotating disk 160 isn't rotated.

Also, when solenoid 238 isn't excited, shutter 236 closes safe dispensing slot 204. Therefore, an object can't be inserted into safe dispensing slot 204, rotating disk 160 isn't rotated. In other words, the coins aren't taken illegally from the coin dispensing safe assemblies 50, 100, 10, 1.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin dispensing apparatus with a safe system comprises:

a coin dispensing member which includes a rotating disk with through holes which is located at the bottom of a coin storing bowl with an upper opening and which is rotated by an electric motor;

a safe housing which contains the coin dispensing member and which can be detached from a coin handling apparatus, and includes a dispensing slot for dispensing coins from the coin dispensing member, the safe housing includes an opening with a lockable cover member to prevent unauthorized access to the coin storing bowl;

an electrical connector on an exterior of the safe housing of a configuration for connection to a source of power to drive the electrical motor; and a disabling unit for stopping the dispensing of coins by the coin dispensing member, when the safe housing is detached from the coin handling apparatus and the electrical connector is disconnected from the source of power, wherein the disabling unit is a rotation preventing unit for locking the rotating disk and the rotating disk is driven by the electric motor through a transfer mechanism, the disabling unit is a stopping tooth which can engage with the transfer mechanism.

2. The coin dispensing apparatus with safe system claimed in claim 1, where the disabling unit further includes a solenoid operatively connected to the electrical connector and a shutter which shuts a dispensing slot for coins when the solenoid is disconnected from the source of power.

3. The coin dispensing apparatus with safe system claimed in claim 1, where an opening for the electrical connector for operating the electric motor is located at a surface of the safe housing for engagement with the coin handling apparatus.

4. The coin dispensing apparatus with a safe system claimed in claim 1, wherein the disabling unit includes a shutter member that closes the dispensing slot.

5. The coin dispensing apparatus and safe system of claim 1 wherein the disabling unit further includes a shutter unit mounted in the safe housing which automatically closes the dispensing slot when the safe housing is detached from the coin handling apparatus.

6. The coin dispensing apparatus and safe system of claim 5 further including a solenoid mounted in the safe housing for holding the shutter unit in an open position.

* * * * *